United States Patent [19]

Makowka

[11] Patent Number: 4,733,817

[45] Date of Patent: Mar. 29, 1988

[54] ENVELOPE SYSTEM WITH MULTIPLE POCKETS

[76] Inventor: Kenneth R. Makowka, 29 Stirrup Place, Wilton, Conn. 06897

[21] Appl. No.: 11,911

[22] Filed: Feb. 5, 1987

[51] Int. Cl.[4] ..... B65D 27/00

[52] U.S. Cl. ..... 229/69; 229/70; 229/72; 383/5

[58] Field of Search ..... 229/69, 70, 72, 74, 229/76, 81, 73; 383/38, 5

[56] References Cited

U.S. PATENT DOCUMENTS

| | | | |
|---|---|---|---|
| 1,013,571 | 1/1912 | Stevens | 229/69 |
| 1,177,886 | 4/1916 | Newcomb | 229/70 |
| 3,537,637 | 11/1970 | Hiersteiner | 229/70 |
| 4,082,880 | 4/1978 | Zboril | 428/220 |
| 4,483,018 | 11/1984 | Whelan | 383/5 |

FOREIGN PATENT DOCUMENTS

| | | | |
|---|---|---|---|
| 85308475.4 | 6/1986 | European Pat. Off. . | |
| 202637 | 11/1982 | New Zealand . | |
| 29481 | of 1906 | United Kingdom | 229/70 |

OTHER PUBLICATIONS

"Safe-Gard Security Envelope", Brochure, Trigon Packaging Systems (NZ), Ltd.

"The Keepsake System", Brochure, Mordon Wrapping, Ltd.

*Primary Examiner*—Willis Little

[57] ABSTRACT

An envelope system is disclosed in which two or more pockets are utilized to receive contents. Each of the pockets have indicia thereon, the indicia of each pocket being at least partially identical with the indicia of all other pockets in a particular envelope system.

33 Claims, 8 Drawing Figures

ENVELOPE SYSTEM WITH MULTIPLE POCKETS

BACKGROUND OF THE INVENTION

This invention relates to a security envelope system and more particularly to a security envelope system having two or more distinct pockets with indicia which enable the pockets to be identifiable as being from the same envelope system.

There is a continuous need for security containers for the shipment and handling of valuable items. In addition to the use of such containers for money, such as the deposit of daily money receipts in a bank's night depository by retail establishments, other items of value must be transferred between parties. These include checks, bonds, stocks, food stamps, coupons, medical reports and sample, jewelry, confidential documents, etc. Because of the underlying value of such items, the containers must be of high integrity. In other words, the container should be capable of being handled during transfer without being broken or opened unintentionally to provide access to the contents. It should remain sound, secure and in tact from shipper to receiver.

Containers of this type have been known in the prior art. For instance, U.S. Pat. No. 4,483,018 discloses a container alleged to be disposable, of high integrity and tamper resistant. The container is formed of thermoplastic with an opening to insert contents. A flap with adhesive is closed over the opening and bonded to the container material. The flat has a detachable end, and both the flap and the detachable end have identical identification indicia thereon. The container also has tamper attempt indicating perforations running through the adhesive and indicia.

Another such security container is disclosed in European patent application No. 85308475.4, published June 4, 1986. Here a single container used as a security bag has a flap and lip which unite through activation of the adhesive. By the use of this structure, the bag cannot be opened without severing the material of the bag, thus, making the bag tamper evident.

The above described prior art discloses single containers having tamper-evident identifiers and identification indicia with a detachable receipt. These devices, however, do not address the problem of placing different classes of items in separate pockets which then must be identified as being in the same shipment at the point of receipt.

Many times a shipper will have different types of items to be shipped at the same time and in the same shipment, but is required to ship the various items in separate packages. However, at the receiving point, all the items shipped in that shipment must be identified as being received. An example of such a business situation is found in the retail store as a supermarket wherein such items as coins, currency, checks, merchandise coupons and food stamps are to be sent from the store to a counting house remotely located from the store by armoured carrier. In this case, each type of item would be packaged separately, but the receipt of all the packages in that shipment from that store would have to be accounted for as being received.

The present invention provides an envelope system with two or more, detachable or undetachable from one another, pockets for this purpose. Each pocket in the envelope system has an indicia and at least a portion of the indicia of each pocket is common with each other pocket in a particular envelope system, By use of this system, items can be packaged separately in a shipment, yet be readily identified as being part of the same shipment from a particular shipper.

SUMMARY OF THE INVENTION

The present invention is an envelope system having two or more pockets, each pocket having identifying indicia thereon. The pockets may be made so that they can be detached from one another in one embodiment. The indicia of a particular pocket within the envelope system contains at least a portion of the indicia common to all the other pockets in that particular envelope system for ready identification of all the pockets of the system. In the embodiment wherein the envelopes are detachable from one another, the system can be used for ready identification of all the pockets of a particular system even after the envelopes in that particular envelope system are detached from one another and may be transported separately.

In various embodiments of the invention, the envelope system pockets may be provided with detachable indicia bearing receipts and tamper evident identifiers, and the envelope material may be a strong, stiff, thin and flexible plastic material. The pockets may be made of materials such as polyethylene, polypropolyene or polyolefin, ect. which in turn may be combined with nylon, surlyn, polyesters or other materials depending upon application requirements.

DETAILED DESCRIPTION OF THE PREFERRED EMBODIMENTS

Figure 1A:
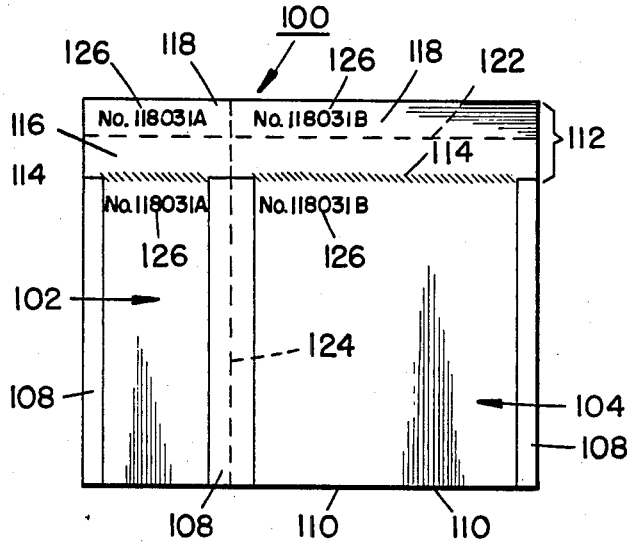
FIGS. 1*a*, 1*b*, 1*c* and 1*d* are schematic illustrations of front, right side, back and left side views, respectively, of a representative envelope system before use wherein the pockets are detachable.
Figure 1B:
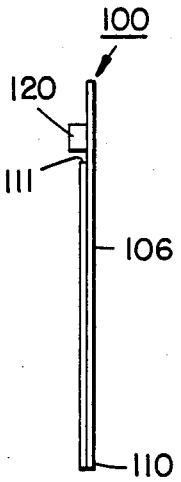
Figure 1D:
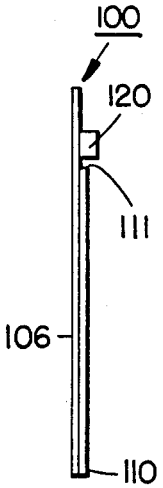
Figure 1C:
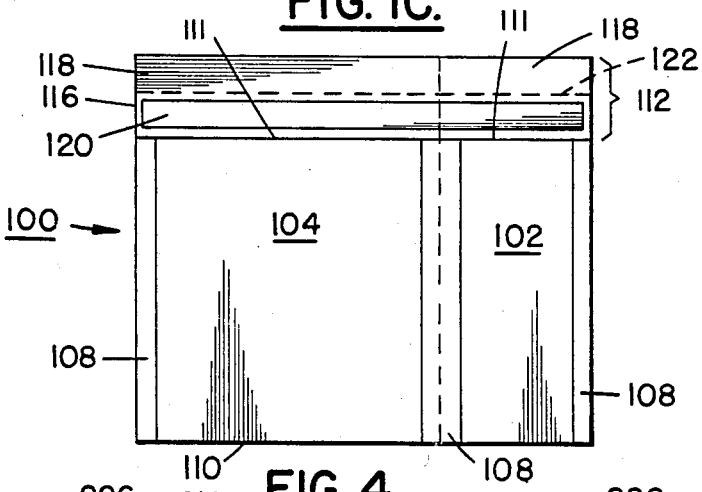

Although the invention is described herein in one environment, that of the shipment of items, particularly valuable items, in a secure manner, it is to be understood that the invention is not so limited. It can be used to ship or bundle any type of item wherein individual pockets are used an envelope system and each of the pockets has an indicia, at least part of which is common with the indicia of the other pockets in that particular envelope system. The individual pockets may be detachable from one another or not depending on intended use.

One embodiment of the invention is shown in FIGS. 1*a*, 1*b*, 1*c* and 1*d* in which an envelope system 100 has two pockets, 102 and 104. The pockets can be any suitable size and shape for holding the items to be contained therein. The pockets within system 100 may be of varying sizes, such as a relatively small pocket 102 and relatively large pocket 104 as shown in FIGS. 1*a–d*, or, in the alternative, the pockets may be the same size.

The envelope system may be made of a single panel of material or of multiple panels. The envelope system 100 shown in FIGS. 1*a–d* is shown as being made of a single panel 106. Panel 106 is folded at 110 to form the front and back sides of the envelope system. In this embodiment of fold 110 forms the bottom portion of each pocket 102 and 104, and the side portions of each pocket are formed by bonding the front and back portions together in regions 108. Bonding can be accomplished by any suitable process such as the application of pressure and heat to the envelope system material where bonding is intended as is well known in the art. After fold 110 is made and bonding is done in regions 108, pockets 102 and 104 are formed, each having a closing means, such as flap 112 shown in this embodiment, extending from its front portion adjacent pocket opening 111 through which items can be inserted into the pocket.

The envelope system panel 106 may be made of any suitable material. If used for security shipments, the panel should be made of a high integity, strong, flexible material which is resistant to tearing and puncturing and which can take high impact stresses and twisting and otherwise relatively rough handling without ill effects. Examples of suitable materials are plastic materials such as polyethylene, polypropylene, polyolefin, etc. For instance, the pocket or envelope material can be made of conventional monolayer films or, in the alternative, multiple layer coextruded or laminated films or construction such as polyethylene, polypropylene, polyolefin, etc. In some applications, the immediately above materials may be combined with nylon, surlyn, foils, polyesters, etc. depending upon application requirements,cost considerations, etc.

The materials disclosed in U.S. Pat. No. 4,082,880, which is incorporated herein by reference in its entirety, can also be used. The thickness of the envelope system material 106 can be of any suitable dimension to provide the characteristics of the material as desired. For example, when using polyethylene or polypropylene, it has been found that a thickness of about 0.0002 inches (2 mils) and heavier works well for a security envelope system.

The envelope system material may be in the from of a single layer or multiple layer laminate or extrusion. The material may be opaque, transluscent, transparent or any mixture thereof. It, of course, can be in any desired color. The material is preferably water-resistant and the resulting pockets, especially in the detachable pocket embodiment, are preferably watertight and airtight. However, in some applications, especially with large size envelopes, small holes may be strategically placed in the pockets to enable air trapped inside the pocket after it is closed to escape may be desirable. The material may also be printed upon to affix the indicia, identify the sender and/or receiver and also provide intended use and instructions on use.

Figure 5:
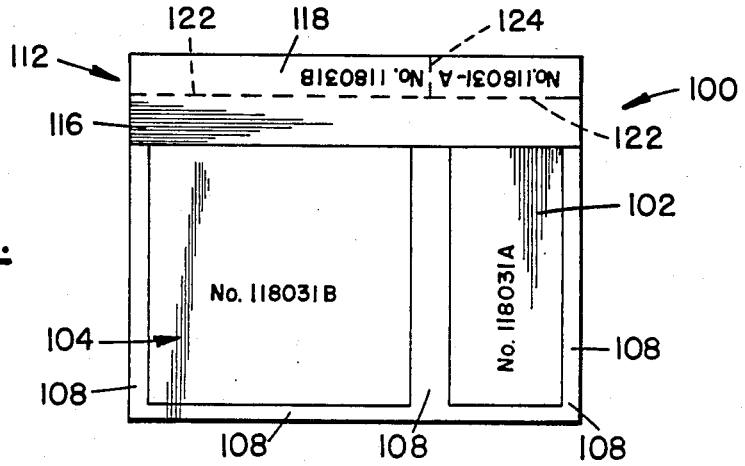
FIG. 5 is a schematic illustration of another embodiment of the envelope system without detachable pockets and with the indicia affixed to the center region of each pocket.

As shown in FIGS. 1*a–d*, flap 112 has a main portion 116 and an end portion 118. A fold area 114 of the flap is shown in FIG. 1*a*. This is the region in which the flap is folded in order to close opening 111 after the contents are placed in the pocket and the flap is to be secured to the pocket. Both the main and end portions of the flaps of each pocket have an identical indicia 126 in this embodiment so that when the end portion of the flap is detached from the flap's main portion a receipt bearing the same indicia as on the pocket is provided. The indicia can be printed on the main portion of the flap or placed on some other part of the pocket such as in the the center region of the pocket as shown in FIG. 5. Although the indicia shown is alphanumeric, any suitable indicia such as graphic, bar codes, colors, holographic, etc. can be used for this purpose. Alternatively, identification indicia shown on the pocket 126 could be placed in the main portion 116 of the flap.

The envelope system shown in FIGS. 1*a–d* has two distinct pockets 102 and 103 with the indicia of "No. 118031A" and "No. 118031B", respectively. Since both pockets 102 and 104 originate from the same envelope system 100, a portion of each pocket's indicia is identical to identify the pockets as being from the same original envelope system after they are detached. The common portion of the indicia is "No. 118031 . . . " in this representative example. Thus, the individual pockets 102 and 104 are identified from the same envelope system, pocket 102 being the ". . . A" pocket, and pocket 104 being the ". . . B" pocket. In the alternative, each pocket from the same envelope system can have totally identical control numbers or indicia, the user relying on this indicia to identify all pockets after detachment from one another. In this manner, by numbering each envelope system with a unique indicia, all of the pockets from a given envelope system can be identified by the unique indicia as being from that particular system after detachment.

Figure 2:
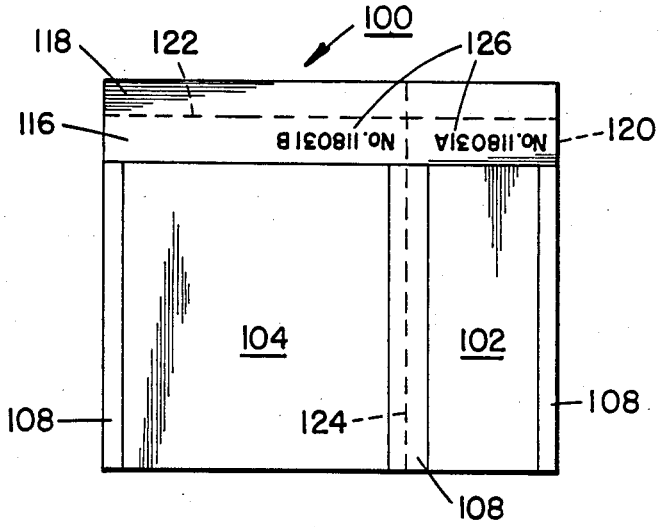
FIG. 2 is a schematic illustration of the back of the envelope system shown in FIGS. 1*a–d* after the contents are placed in the pockets and the flaps are folded over the opening and secured to the pocket material.

There must be a means to secure the opening of each pocket after the contents are inserted. In the embodiment of FIGS. 1*a–d*, this is done by adhesive material 120 residing on the main portion 116 of the flap. Any suitable securing means can be used such as an adhesive strip that has a peel back top strip which is removed just prior to activating the adhesive. In this case, the contents are placed in the pockets, the peel back top strip removed from the adhesive, the flap folded over the opening to close the opening and pressure applied to the main portion of the flap to seal the flap onto the pocket. After this is done, the envelope system will be placed in the condition as shown in FIG. 2.

Returning to FIGS. 1*a–d*, it can also be seen that the envelope system has perforations 122 and 124. Perforations 122 enable the user of the envelope to detach the end portion of the flap 118 to produce a receipt with indicia. Perforations 124 on the other hand, enable the pockets 102 and 104 to be detached from one another. Perforation 122 and 124 may be used for detachment before or after the items are placed in the pockets or before or after the flaps are secured to the pockets. In the case of perforations 124, the placement of the perforations in the bonding region should be such that after detachment, each pocket is still bonded along its side.

Any suitable means may be used to detachably hold the individual pockets together to form the envelope system 100. Although detachment of the pockets from one another is shown in FIGS. 1*a–d* as by the use of perforations in the bonded area between the pockets, other means may be used. For instance, the pockets could be held together by tape, glue, or by the applications of laminates such as mylar, nylon or other suitable materials.

FIG. 5 shows a non-detachable pocket envelope system. Here only the end portions 118 of the flaps 112 optionally have perforations 124 since the pockets 102 and 104 are not intended to be detached from one another in this embodiment. When the pockets are not intended to be detachable as shown in FIG. 5, the entire envelope of two or more pockets is used for shipment regardless whether all of the individual pockets in the envelope system have contents or not. In the detachable pocket embodiment shown in FIGS. 1*a–d*, on the other hand, only those pockets holding contents may be optionally transported while the remainder may be discarded or used for another different shipment by the user.

Regardless of the means by which the pockets are held ogether before detachment such means should be activated (pockets detached) manually to keep the separation as uncomplicated a process as possible for the shipper. However, in some instances, machine, chemical or electrical separation of the pockets may be desirable with the presently disclosed system.

Figure 3:
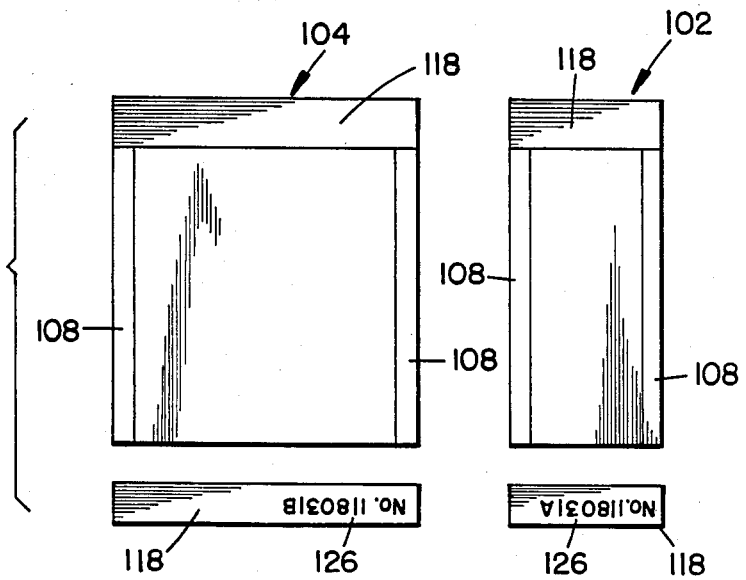
FIG. 3 is a schematic illustration of the distinct pockets of the envelope system shown in FIG. 2 after they have been detached from one another and the indicia bearing receipts have been detached from the flaps.

FIG. 3 shows the pockets 102 and 104 of envelope system 100 detached from one another and end portions 118 of the flaps bearing indicia 126 detached for receipt purposes. At this time the pockets may be shipped to their destination(s).

Figure 4:
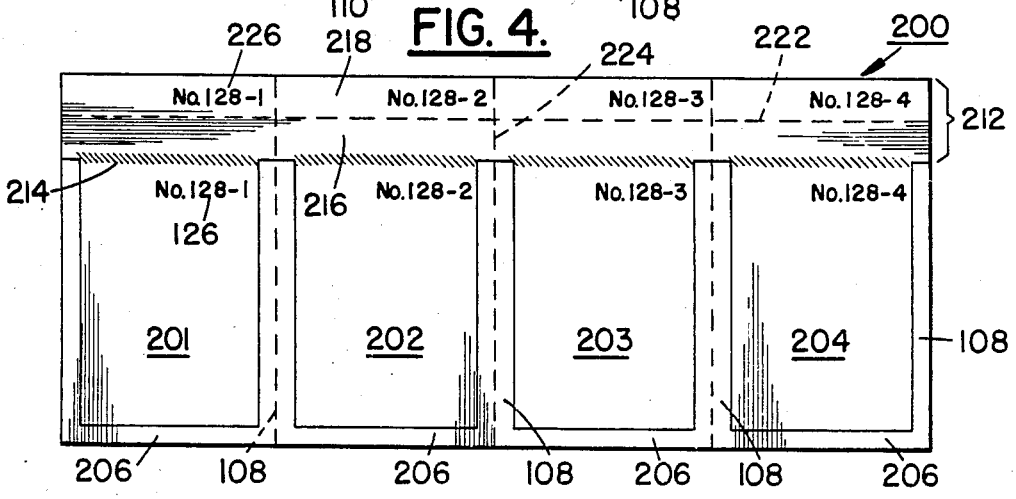
FIG. 4 is a schematic illustration of the front of another embodiment of the envelope system having four pockets.

FIG. 4 shows another embodiment of the envelope system, system 200, having multiple pockets, 201, 202, 203 and 204. In this embodiment, the envelope system is constructed of two panels of material and thus the bottom portion of each pocket is also bonded, 206, along with side portion 108. Each pocket has a flap 212, and each flap has an end portion 218 detachable from the main portion 216 by perforations 222. Each pocket as well as its flap has indicia 226 located on it. Finally, perforations 224 within the bonding regions 108 between the adjacent pockets permit detachment of the pockets from one another.

The pockets of the envelope system disclosed herein can be made tamper evident in any suitable fashion. For instance, as disclosed in U.S. Pat. No. 4,483,018, the flaps of each pocket in the present system may incorporate a third line of perforations across the width thereof running through both the main portion of the flap containing the adhesive material and the identification indicia thereon. The third line of perforations can be arranged such that attempts to open the enclosure along the opening through which contents are inserted would disrupt the continuity of the flap and identification indicia. U.S. Pat. No. 4,483,018 is incorporated herein by reference in its entirity. Other methods of providing tamper evidency are possible such as by extending the material of the main portion 116 of the flap by a suitable distance horizontally (as viewed in FIGS. 1*a* and 1*c*), for instance, by $\frac{1}{4}$ to $\frac{1}{2}$ inches, and folding this extra material around the sides of the pockets or envelope and affixing the extra material thereto such as by sealing.

Many alternatives and enhancements can be made to the invention as disclosed above. For instance, the pockets can be made disposable after a single use or can be used several times. The number of pockets in a single envelope system can be matched to the number of item types to be handles by that particular system; e.g., 8, 12, 16, or more individual pockets can be placed in an envelope system. The envelope system material can be as flexible or stiff as the application requires. The individual pockets can be made in a relatively flat configuration as viewed from the side in FIGS. 1*b* and 1*d*, or can be made to receive thicker materials by such means as providing expandable folds in the front and back portions of the pockets.

The flaps and openings of all the pockets need not be placed on the same edge portions of the envelope system. For instance, they can be placed at opposite edges, from pocket to pocket in a particular envelope system. Also, openings with flaps can be placed at more than one end of any particular pocket. The front and/or back portions of the pockets may have address windows and areas which are particularly adapted to receive stamps and typewritten or handwritten addresses and instructions. In addition, a pocket may have an additional envelope attached to it for mailing purposes, etc.

It is also possible to construct the pockets without the flap attached. In this case the flap could be a separate item which would be applied over the opening of a pocket with means to secure the opening, such as two strips of adhesive with a fold in between so that the strips can be sealed to the front and back portions of the pocket, respectively, to close the pocket opening. In this case the flaps could be preprinted with indicia to match that of the pocket, or a particular envelope system, or could have a region thereon for the user to write in the pockets' indicia.

It should be understood that the foregoing description is only illustrative of the invention. Various alternatives and modifications can be devised by those skilled in the art without departing from the intended to embrace all such alternatives, modifications and variances which fall within the scope of the appended claims.

I claim:

1. An envelope system made of a material for the placement of contents therein comprising:

at least two pockets detachably connected to form an envelope system;

each pocket having a securely closed periphery except for an opening means thereof through which contents can be placed into the pocket, and closing means which is adapted to close and secure the opening after the contents are placed into the pocket, the closing means providing a completely closed pocket after the closing means is closed and secured over the opening;

the closing means of each pocket having two portions, a main portion having a securing means for securing the closing means to the envelope material over the opening of the pocket and a detachable end portion which can be removed from the main portion of the closing means as a receipt;

the closing means of a first pocket having first indicia on its end portion identifying the first pocket, the first indicia also being on the first pocket or the main portion of the closing means associated with the first pocket; and the closing means of each other pocket in the envelope system having at least a portion of the first indicia of the first pocket on its respective end portion, at least a portion of the first indicia also being on each other pocket or the main portion of the closing means associated with each other pocket in the envelope system, identifying said each other pocket as being part of the same envelope system whereby all pockets even though detached from one another can be readily identified as being from the same envelope system and detachable receipts are provided for each pocket.

2. The system as in claim 1 wherein there are more than two pockets.

3. The system as in claim 1 wherein the two pockets are substantially the same size.

4. The system as in claim 1 wherein the two pockets are of different sizes.

5. The system as in claim 1 wherein the envelope system is constructed of a single panel of material wherein the pockets have a bottom portion opposite the opening means which is formed by a folded portion of the material, the fold forming in front and back of the pocket, and side portions between the opening means and bottom portion formed by the bonding of the front and back portions of the pocket.

6. The system as in claim 5 wherein the side portions of two adjacent pockets contain the detachable means for detaching one pocket from another.

7. The system as in claim 6 wherein the detachable means includes perforations in the side portions of pockets adjacent one another.

8. The system as in claim 1 wherein the envelope system is constructed of at least a front and back panel of material wherein the pockets have a bottom portion opposite the opening means and side portions between the opening means and bottom portions, the front and back panels being bonded together to form the bottom and side portions.

9. The system as in claim 1 wherein the closing means has perforations for detaching the end portion from the main portion thereof.

10. The system as in claim 1 wherein the securing means of the flap means is a sealable material which seals the flap to the pocket.

11. The system as in claim 10 wherein the sealable material is one which is activated by placing the flap onto the envelope to close the opening and applying pressure to the flap.

12. The system as in claim 1 wherein the closing means is a flap means integral with the pocket.

13. The system as in claim 1 wherein the closing means is a separate member from the pocket.

14. The system as in claim 1 wherein the envelope material is a plastic material.

15. The system as in claim 1 wherein the envelope material is a monolayer film.

16. The syatem as in claim 1 wherein the envelope material is a multiple layer coextruded film.

17. The system as in claim 1 wherein the envelope material is a laminated film.

18. The system as in claim 1 wherein the envelope material is polyethylene.

19. The system as in claim 18 wherein the polyethylene is combined with nylon.

20. The system as in claim 18 wherein the polyethylene is combined with foils.

21. The system as in claim 18 wherein the polyethylene is combined with polyester.

22. The system as in claim 1 wherein the envelope material is polypropylene.

23. The system as in claim 22 wherein the polypropylene is combined with nylon.

24. The system as in claim 23 wherein the polypropylene is combined with foils.

25. The system as in claim 23 wherein the polypropylene is combined with polyester.

26. The system as in claim 1 wherein the envelope material is polyolefin.

27. A tamper evident security envelope system made of a relatively thin, high integrity material for the placement of contents therein comprising:

multiple pockets forming the envelope system;

each pocket having an opening means therein through which contents can be placed into the pocket and closing means which can be secured onto the pocket to close the opening securely, the pocket and secured closing means forming a completely closed pocket;

tamper-evident means on each closed pocket through which attempts to open the pocket in the closing means region will disrupt the continuity of the closing means so as to make it evident that tampering of the pocket has occured; and the closing means having indicia thereon, the indicia of each closing means in the envelope system having at least a portion of its indicia common with the other closing means in the envelope system.

28. The system as in claim 27 wherein the pockets are made of a plastic film.

29. The system as in claim 27 wherein the multiple pockets are detachably connected to form the envelope system and upon the pockets in a particular envelope system being detached from one another, the pockets can be identified as coming from the same envelope system by said common indicia.

30. A security envelope system made of a relatively thin, high integrity material for the placement of contents therein comprising:

at least two pockets forming an envelope system, the pockets being made of a plastic film;

each pocket having a securely closed periphery except for an opening means thereof through which contents can be placed into the pocket, and closing means which is adapted to close and secure the opening after the contents are placed into the pocket, the closing means providing a completely closed pocket after the closing means is closed and secured over the opening;

the closing means of each pocket having two portions, a main portion having a securing means for securing the closing means to the envelope material over the opening of the pocket and a detachable end portion which can be removed from the main portion of the closing means as a receipt;

the closing means of a first pocket having first indicia on its end portion identifying the first pocket, the first indicia also being on the first pocket or the main portion of the closing means associated with the first pocket; and the closing means of each other pocket in the envelope system having at least a portion of the first indicia of the first pocket on its respective end portion, at least a portion of the first indicia also being on each other pocket or the main portion of the closing means associated with each other pocket in the envelope system, identifying said each other pocket as being part of the same envelope system whereby all pockets have detachable receipts provided therefore.

31. The system as in claim 30 wherein the envelope material is a multiple layer coextruded film.

32. The system as in claim 31 wherein the film comprises polyethylene, polypropylene or polyolefin materials.

33. The system as in claim 32 wherein the construction of the film further includes nylon, polyester or foil materials.

* * * * *